US006519996B1

(12) United States Patent
Gasparini

(10) Patent No.: US 6,519,996 B1
(45) Date of Patent: Feb. 18, 2003

(54) PRESSING-BENDING MACHINE WITH A DEVICE FOR DETECTING THE LOWER AND UPPER CROSS-MEMBERS DEFLECTION, AIMED AT INTERACTING WITH AT LEAST ONE CROWNING SYSTEM

(76) Inventor: Luciano Gasparini, Via Storti 11, 31036 Istrana (TV) (IT)

( * ) Notice: Subject to any disclaimer, the term of this patent is extended or adjusted under 35 U.S.C. 154(b) by 0 days.

(21) Appl. No.: 09/529,731

(22) PCT Filed: Oct. 9, 1998

(86) PCT No.: PCT/IT98/00271

§ 371 (c)(1),
(2), (4) Date: Jun. 26, 2000

(87) PCT Pub. No.: WO99/20410

PCT Pub. Date: Apr. 29, 1999

(30) Foreign Application Priority Data

Oct. 17, 1997 (IT) ..... TV97A0141

(51) Int. Cl.[7] ..... B21D 5/02
(52) U.S. Cl. ..... 72/389.5; 72/389.3
(58) Field of Search ..... 72/389.3, 389.4, 72/389.5

(56) References Cited

FOREIGN PATENT DOCUMENTS

| | | | |
|---|---|---|---|
| FR | 2708219 | * | 2/1995 |
| JP | 59193718 | | 11/1984 |
| JP | 359193718 | * | 11/1984 |
| JP | 360166123 | * | 8/1985 |
| JP | 4105714 | | 4/1992 |
| JP | 404105714 | * | 4/1992 |
| JP | 8150416 | | 6/1996 |

OTHER PUBLICATIONS

Japanese Abstract, Toshiaki, pub. No. 08150416, published Nov. 6, 1996.*

* cited by examiner

*Primary Examiner*—David Jones
(74) *Attorney, Agent, or Firm*—Meyertons, Hood, Kivlin, Kowert & Goetzel, P.C.; Eric B. Meyertons

(57) ABSTRACT

A pressing-bending machine with a device for detecting the lower and upper cross-members deflection, aimed at interacting with at least one crowning system, essentially made up of means suitable for detecting the elastic deformation on the lower and/or upper cross-member (1, 4) vertical axis recorded during the plate pressing-bending active phase, said means, supplying the machine management logic unit with a higher or lower value respect to an upper cross-member reference value, from this depending the intervention of at least the crowning system, and also in which, said means, being active on both cross-members, comprise a part engaged to the action cross-member and a part, interconnected with the first one, integral with a fixed external cross-member independent from the action cross-member, comprising a means (8) for detecting and communicating the deflection relative to this latter with respect to the fixed external cross-member.

4 Claims, 3 Drawing Sheets

PRESSING-BENDING MACHINE WITH A DEVICE FOR DETECTING THE LOWER AND UPPER CROSS-MEMBERS DEFLECTION, AIMED AT INTERACTING WITH AT LEAST ONE CROWNING SYSTEM

BACKGROUND OF THE INVENTION

1. Field of the Invention

The described embodiments relate to plate bending devices. More particularly, the described embodiment relates to pressing-bending machines that include a device for detecting the bending in the lower and upper cross-members.

2. Description of the Related Art

Pressing-bending machines are used in the metal and mechanical industry and, in particular, for sheet-plate working and manufacturing. Pressing-bending machines are used for the production of differently shaped longitudinal profiles in a piece of metal. Pressing-bending machines may optionally be capable of subjecting each sheet of metal to multiple bending cycles.

Generally, a bending cycle includes having a punch tool vertically descend onto a metal sheet-plate located on a matrix-die, bending the metal sheet-plate, and raising the punch tool up to the original position.

A pressing-bending machine may be made up of two elements. The two elements include a dynamic element, generally associated with the upper part of the machine, and a substantially static element known as the matrix support, associated with a lower part of the machine. The matrix support is placed vertically below the dynamic element.

In performing a bending cycle, a punch tool, including an interchangeable blade having a variety of shapes, is positioned in the dynamic element. The dynamic element vertically reciprocates the punch tool using at least two lubricated-dynamic cylinders. These cylinders typically control the descending, stopping, and rising of an upper cross-member of the dynamic element. The upper cross member longitudinally supports the punch tool.

The lower part of the pressing-bending machine includes a lower cross-member, which provides support for a matrix-die and measuring devices during use. French Patent No. 2,708,219 teaches a lower cross-member that may include devices for measuring and controlling the bending angle and deflection of the matrix-die at different points along the support matrix. Japanese Patent No. JP59193718 teaches maintaining the two dies in a parallel orientation. Japanese Patent No. JP8150416 teaches control of the respective deflection of the dies by use of detecting sensors. JP8150416 also teaches controlling the shape of the convex surface using a three-cylinder device to deflect the entire matrix portion. Japanese Patent No. JP4105714 teaches correction of central slack in the matrix when an environmental temperature is changed. JP4105714 further teaches that a lower die is slideably positioned between two guide plates. The lower die has a lower stroke sensor measuring the relative movement of the guide plates in relationship to a lower movable bending tool. The lower stroke sensor measurements allow correction of the lower bending tool acting with a lower counter cylinder. All these solutions teach detecting movement of the lower matrix or lower die with respect to the lower cross-member and the guide that supports it.

From a structural viewpoint, precision bending machines typically include a dynamic lower cross-member which allows the production of a high quality product. In contrast, machines that include a static lower member generally produce a lower quality product. The need to use machines which have a dynamic lower cross-member, is typically preferred by manufacturers. The costs for providing a dynamic lower cross-member, even if an optional one, are rather marginal with respect to the machine's total cost.

One motivation for companies to use machines which have a dynamic lower cross-member is that the dynamic lower cross-member may help in correcting those imperfections; which cause a bending camber during the sheet-plate manufacture process.

The sheet-plate pressing-bending process may be difficult due to the required tolerances. A variety of factors may influence the accuracy of a sheet-plate manufacturing process. For example, changes in the thickness of a few centimeters in the sheet, in addition to the material quality of the sheet, may affect the accuracy of the sheet-plate manufacturing process. The elastic return of the material may also affect the accuracy of the sheet-plate manufacturing process. During the sheet-plate manufacturing process, the natural deformation of the two cross-members may also affect the accuracy of the process. The aforementioned factors are presently corrected by means of a computer controller that is coupled to the pressing-bending machine. The computer controllers may use suitable data, derived from previous tests and other manually operated systems that allow the controller to adjust the sheet-plate manufacturing process in a predetermined manner.

The deformation of the lower and upper cross-members of a pressing-bending machine is common to most pressing-bending machines. Such deformations during the processing of the sheet metal may be detected by noting a certain convexity or concavity along a transverse axis of the product. This "crowning" or bending of the sheet metal may also be ascribed to the uneven force distribution on the upper cross-member cylinders.

Correction devices may be coupled to the bending machine to correct crowning or bending defects by allowing dynamic movement of the lower cross-member adjust for the intensity and distribution of the working pressure from the upper cross-member push cylinders. The dynamic movement of the lower cross-member may correct the bending camber caused by the bending strain on both cross-members. Typically, the bending camber is proportional to bending strain. The correction devices, though suitable for communicating with a computer controller of the bending machine, are typically not optimal because of a variety of factors, which reduce the correction device efficiency.

One factor for a reduction in efficiency may be that process corrections need continuous and special adjustments. These adjustments may not be singularly repeated, due to the changeable working conditions and the structural composition of the material used in manufacture. Changing working conditions may include the length of the piece to be bent, the thickness, the material's maximum stress but primarily its longitudinal position in the pressing-bending machine where the bending operation may be carried out.

Hydraulic crowning systems of a press-bending machine typically includes a series of jacks, which may interact together at a lower intermediate section of an action cross-member. The action cross-member may be external to a corresponding reaction cross-member.

A frequent problem of a hydraulic crowning system may be that the deformation adjustment may be based on pre-set empirical parameters managed by a computer controller.

Presently, the computer controller program variables may be obtained by sampling stages of repeated tests during normal and routine working conditions. The working conditions may correspond to a central positioning of a plate to be pressed-bent, and not to a final positioning of the plate in a cross-member. Pre-setting a suitable parameter may be difficult because of the different variables that influence the cross-members deformation during a work cycle. Specifically, the variables necessary for accurate correction of the cross-member deformation may be different from the routine working conditions.

Another definite lack of precision in the pressing-bending machines may be attributed to the absence of real data, supplied simultaneously with the pressing-bending operations. The real data may take into account the deformation, specifically, the bending or crowning of the cross-members. In addition, the lack of precision may influence the quality of the process by causing a considerable amount of scraps and/or may result in repeating a work cycle to correct an error.

SUMMARY OF THE INVENTION

A pressing-bending machine includes an upper cross member configured to support a punch. An upper fixed cross member is coupled to the upper cross member. The pressing-bending machine also includes a lower cross member positioned below the upper cross member. The lower cross member is configured to support a matrix-die. The lower cross member is composed of a lower action cross member, a first lower cross member guide, a second lower cross member guide, and a lower fixed cross member. The first and second lower cross member guides are positioned on opposing surfaces of the lower action cross member. The lower fixed cross member is coupled to the first lower cross member guide. The first and second lower cross member guides are independently movable with respect to each other. Detection devices are coupled to the upper and lower cross members. An upper detection device is coupled to the upper cross member. The upper detection device is configured to detect elastic deformation along a vertical axis of the upper cross member during use. The upper detection device includes at least one upper position transducer. The upper position transducer is coupled to the upper cross member. The upper position transducer includes a movable stem rod horizontally hinged to a pin. The pin is orthogonally coupled to the upper cross member through the upper fixed cross member. The stem rod of the upper position transducer is vertically movable with respect to the upper fixed cross member.

A lower detection device is coupled to the lower cross member. The lower detection device is configured to detect elastic deformation along a vertical axis of the lower cross member. The lower detection device includes at least one lower position transducer. The lower position transducer is coupled to the lower action cross member. The lower position transducer includes a movable stem rod horizontally hinged to a pin. The pin is orthogonally coupled to the lower action cross member through the lower fixed cross member and the first lower cross member guide. The stem rod of the lower position transducer is vertically movable with respect to the lower fixed cross member.

An upper control device is coupled to the upper cross member. The upper control device is configured to control elastic deformation along a vertical axis of the upper cross member. A lower control device is coupled to the lower cross member. The lower control device is configured to control elastic deformation along a vertical axis of the lower cross member.

Advantages are obtained which further improve existing pressing-bending machines. First, a hydraulic crowning system and a device for bending camber correction may include a system that may influence the intensity and distribution of the working pressure of a group of upper cross-member push cylinders. Specifically, the system may intervene more accurately than in other systems by taking into account the cross-members bending real values. As a consequence, obtaining high quality and precise results may be possible, independent of the material's position with respect to the pressing-bending machine and material's technical characteristics.

The end user may not need to perform any necessary adjustments, which may allow an essential faultless bending action. Press-bending cycle times may increase the economics of manufacture. The control device may allow improved working flexibility of the pressing-bending machine computer controller.

BRIEF DESCRIPTION OF THE DRAWINGS

Further advantages of the present invention will become apparent to those skilled in the art with the benefit of the following detailed description of the embodiment and upon reference to the accompanying drawings in which.

DETAILED DESCRIPTION OF THE EMBODIMENTS

Figure 1:
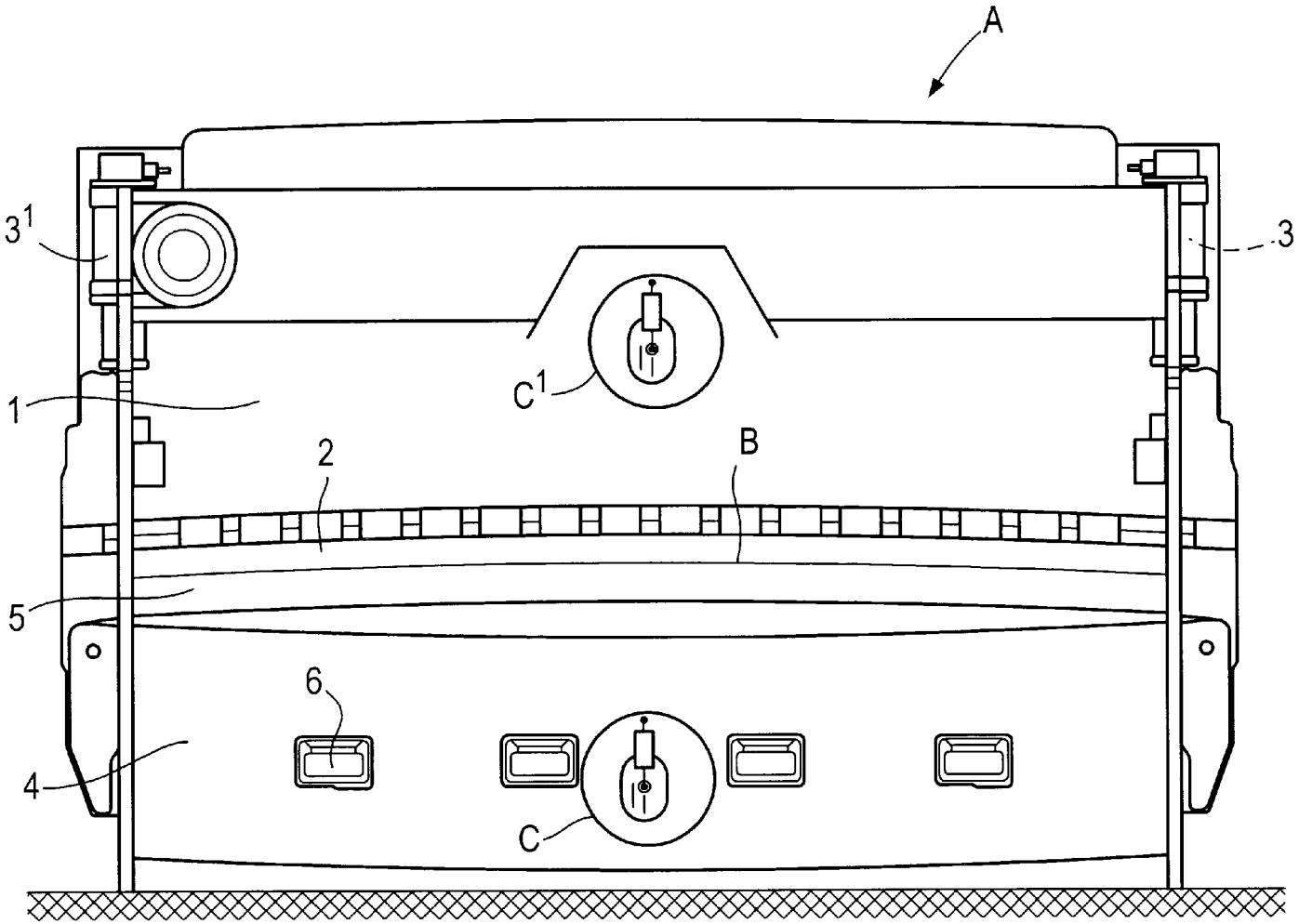
FIG. 1 depicts a perspective view of a pressing-bending machine which is provided with a device for the direct electronic control of bending of the lower and upper cross-members.

Referring to FIG. 1, pressing-bending machine A includes an upper cross-member 1, which moves vertically with respect to a frame. Positioned at the lower end of upper cross-member 1 is punch tool 2. Punch tool 2 includes interchangeable blades. Machine A includes cylinder group 3 and $\mathbf{3}^1$ located at the end of each side of upper cross-member 1. Cylinder group 3 and $\mathbf{3}^1$ control a raising and lowering vertical movement of upper cross-member 1 in the direction of underlying lower cross-member 4. Lower cross-member 4 includes interchangeable matrix-die 5.

Figure 8:
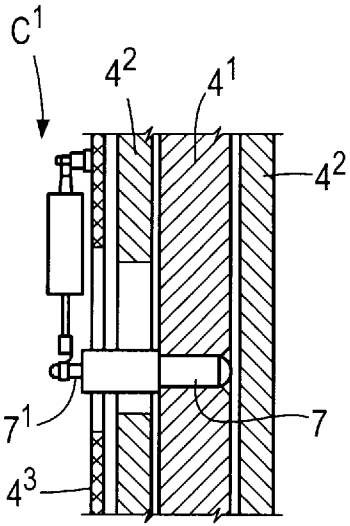
FIG. 8 depicts a cross-sectional view of the control device depicted in FIG. 6.
Figure 9:
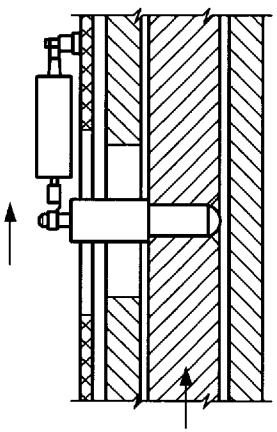
FIG. 9 depicts a cross-sectional view of the control device depicted in FIG. 7.

Pressing-bending machine A includes upper and lower control devices coupled to the upper and lower cross-members respectively. The upper and lower control devices include a series of hydraulic jacks 6. Hydraulic jacks are configured to provide correction of crowning of the plate due to bending strains induced in the plate during the bending process. As depicted in FIG. 8, lower action cross-member is positioned between first and second lower cross-member guides $4^2$. The control devices may also be controlled with an internal circuit device that adjusts the crowning pressure proportionally to the working pressure of single cylinders 3 and $3^1$ of upper vertical cross-member 1.

Detection devices, C and $C^1$, are included for each of the lower and upper cross-members. Detection devices C and $C^1$ measure a bending of the cross-members while simultaneously supplying real deformation data to a machine's computer controller. The computer controller calculates a suitable intervention of the control device on the cross members. Intervention on the cross members is performed with hydraulic jacks and or through a device for adjusting the crowning pressure proportionally to the working pressure of single cylinders 3 and $3^1$.

As depicted in FIG. 1, a detection device C is positioned near a longitudinal center of lower cross-member 4 of press-bending machine A. Detection device C is depicted in more detail in FIGS. 6–9. Detection device C includes pin 7 orthogonally coupled to lower action cross-member $4^1$. Pin 7 is coupled to lower action cross member $4^1$ through first lower cross-member guide $4^2$ and lower fixed cross-member $4^3$. Lower fixed cross-member guide C is of a thickness less than first lower cross-member guide $4^2$. Lower fixed cross-member $4^3$ is positioned on the exterior face of first lower action cross-member guide $4^2$. Lower fixed cross-member $4^3$ independently moves with respect to first lower action cross-member guide $4^2$ and is coupled to machine A.

Figure 6:
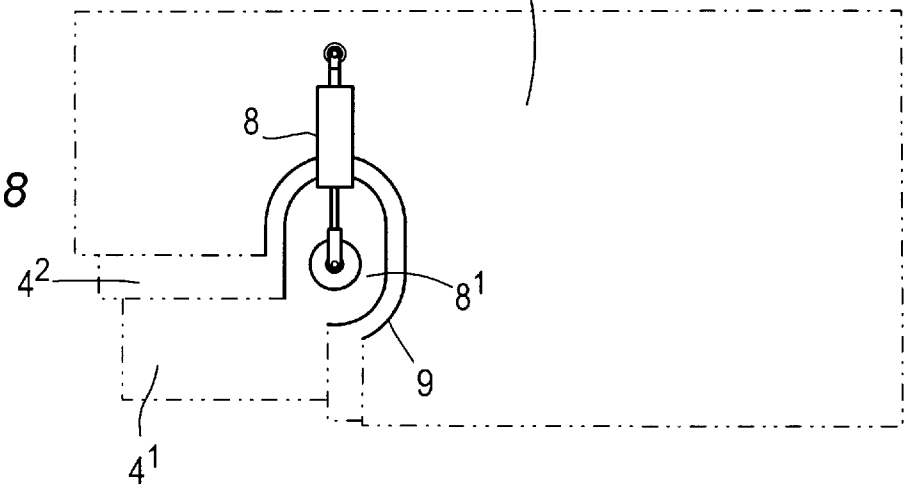
FIG. 6 depicts a side view of a control device coupled to the lower cross member in a stopped position.
Figure 7:
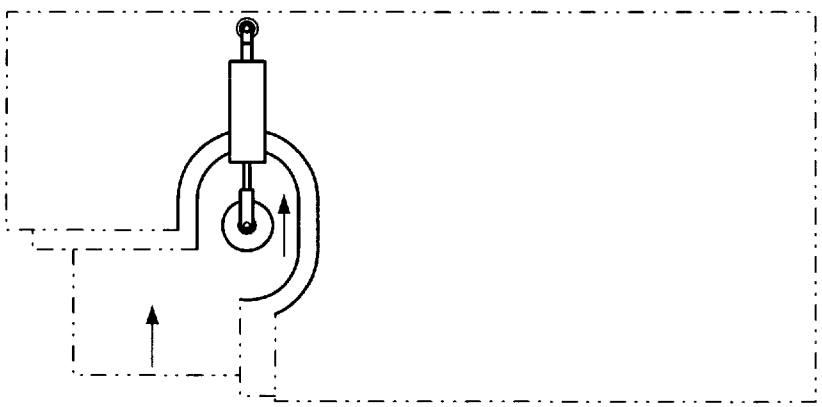
FIG. 7 depicts a side view of the control device of FIG. 6 in an active position.

Lower fixed cross-member $4^3$ includes a slot-like shaped opening 9 which is configured to allow pin 7 and projecting part $7^1$ of pin 7 free oscillation while coupled to lower action cross-member. As depicted in FIG. 6, small moveable rod stem $8^1$ is located at the lower end of position transducer 8. Projecting part $7^1$ horizontally hinges onto the end of rod stem $8^1$. Lower position transducer 8 is coupled to an exterior of lower third cross-member $4^3$ and is aligned with respect to the sheet bending process on underlying action cross-member $4^2$.

A slight displacement of lower action cross-member $4^2$ on a vertical axis, corresponds to an equal oscillation of rod stem $8^1$. Interaction of rod stem $8^1$ with the overhanging fixed point allows for quantification of a relative displacement.

As depicted in FIG. 1, upper element of press-bending machine A includes movable cross-member 1. Upper action cross-member 1 supports punch tool 2. On the same engagement side as detection device C on lower cross-member 4, second detection device $C^1$ is aligned with underlying device C. Detection device $C^1$ is centrally positioned longitudinally with respect to pressing-bending machine A.

Figure 2:
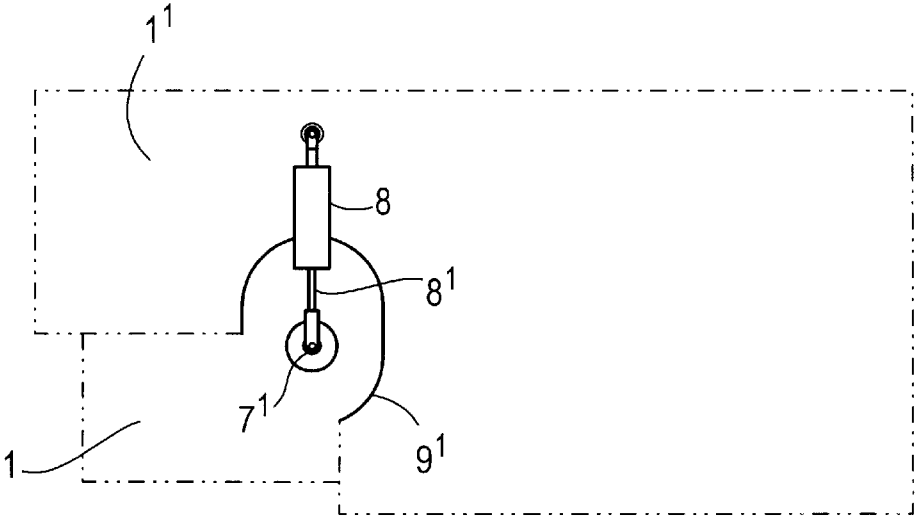
FIG. 2 depicts a side view of a control device coupled to the upper cross member in a stopped position.
Figure 3:
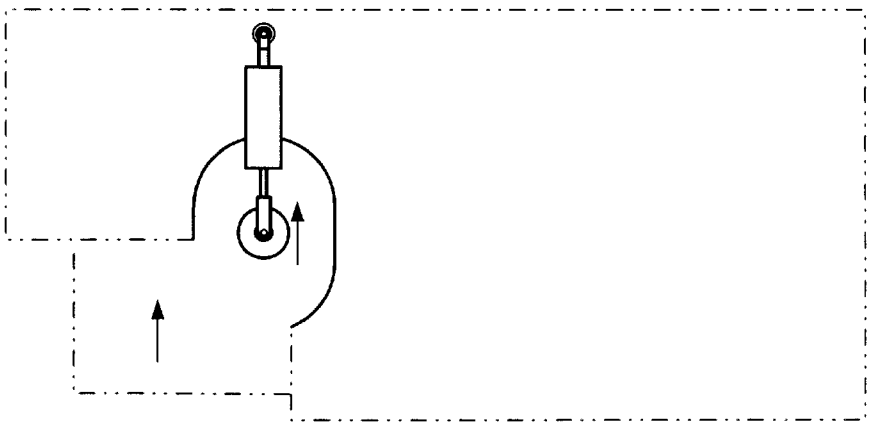
FIG. 3 depicts a side view of the control device of FIG. 2 in an active position.
Figure 4:
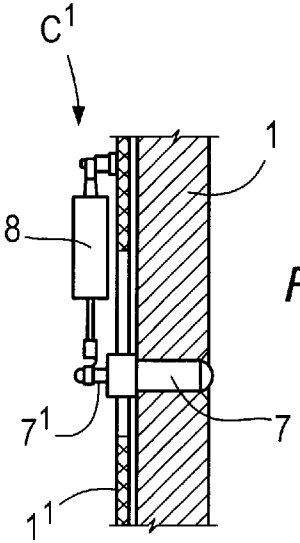
FIG. 4 depicts a cross-sectional view of the control device depicted in FIG. 2.
Figure 5:
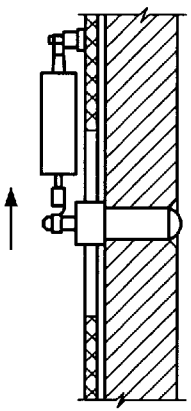
FIG. 5 depicts a cross-sectional view of the control device depicted in FIG. 3.

FIGS. 2–5 depict more detailed views for detection device $C^1$. Detection device $C^1$ includes an analogous pin 7 orthogonally coupled to upper action cross-member 1. Pin 7 includes projecting pin part $7^1$ with respect to upper fixed cross-member $1^1$. Upper fixed cross-member $1^1$ is of a thickness less than upper action cross-member 1, and is coupled to pressing-bending machine A frame. Upper fixed cross-member $1^1$ is positioned facing the exterior of the upper action cross-member 1. Pin 7 couples to upper cross-member 1. Fixed cross-member $1^1$ includes an opening $9^1$ which is configured to allow oscillation of pin 7. As depicted in FIG. 2 at the lower part of position transducer 8 is located a small moveable rod stem $8^1$. Projecting part $7^1$ is horizontally hinged into the end of the rod stem $8^1$. Rod stem $8^1$ interacts with a fixed part of position transducer 8 coupled to an external surface of fixed cross-member $1^1$.

Further modifications and alternative embodiments of various aspects of the invention will be apparent to those skilled in the art in view of this description Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the,invention may be utilized independently, all as would be apparent to one skilled in the art after having the benefit of this description of the invention. Changes may be made in the elements described herein without departing from the spirit and scope of the invention as described in the following claims.

What is claimed is:

1. A pressing-bending machine comprising:

an upper cross member configured to support a punch;

an upper fixed cross member coupled to the upper cross member;

a lower cross member positioned below the upper cross member, the lower cross member configured to support a matrix-die; the lower cross member comprising a lower action cross member, a first lower cross member guide and a second lower cross member guide, the first and second lower cross member guides being positioned on opposing surfaces of the lower action cross member, and a lower fixed cross member coupled to the first lower cross member guide, wherein the first and second lower cross member guides are independently movable with respect to each other;

an upper detection device coupled to the upper cross member, the upper detection device configured to detect elastic deformation along a vertical axis of the upper cross member; the upper detection device comprising at least one upper position transducer coupled to the upper cross member, the upper position transducer comprising a movable stem rod, wherein a first end of the stem rod of the upper position transducer is horizontally hinged to a pin of the upper position transducer and wherein a second end of the stem rod of the upper position transducer is coupled to the upper fixed cross member, wherein the pin of the upper position transducer is orthogonally coupled to the upper cross member through the upper fixed cross member, and wherein the stem rod of the upper position transducer is vertically movable with respect to the upper fixed cross member;

a lower detection device coupled to the lower cross member, the lower detection device configured to detect elastic deformation along a vertical axis of the lower cross member, the lower detection device comprising at least one lower position transducer coupled to the lower action cross member, the lower position transducer comprising a movable stem rod, wherein a first end of the stem rod of the lower position transducer is horizontally hinged to a pin of the lower position transducer and wherein a second end of the stem rod of the lower position transducer is coupled to the lower fixed cross member, wherein the pin of the lower position transducer is orthogonally coupled to the lower action cross member through the lower fixed cross member and the first lower cross member guide, and wherein the stem rod of the lower position transducer is vertically movable with respect to the lower fixed cross member;

an upper control device coupled to the upper cross member, the upper control device configured to alter elastic deformation along a vertical axis of the upper cross member; and a lower control device coupled to the lower cross member, the lower control device configured to alter elastic deformation along a vertical axis of the lower cross member.

2. The pressing-bending machine of claim 1, wherein the upper control device includes a hydraulic jack configured to interact with the upper cross member in response to bending detected by the upper detection device.

3. The pressing-bending machine of claim 1, wherein the lower control device includes a hydraulic jack configured to interact with the lower cross member in response to bending detected by the lower detection device.

4. The pressing-bending machine of claim 1, wherein the upper control device includes a hydraulic jack configured to interact with the upper cross member in response to bending detected by the upper detection device, and wherein the lower control device includes a hydraulic jack configured to interact with the lower cross member in response to bending detected by the lower detection device.

* * * * *